United States Patent [19]

Mo

[11] 3,945,212

[45] Mar. 23, 1976

[54] ARRANGEMENT IN OR RELATING TO CAISSONS OR THE LIKE

[76] Inventor: Olav Mo, Gronsundveien 94, 1360 Nesbru, Norway

[22] Filed: Dec. 5, 1973

[21] Appl. No.: 421,794

[30] Foreign Application Priority Data

Dec. 5, 1972 Norway ..... 4472/72

[52] U.S. Cl. ..... 61/46.5; 61/50; 61/53.74

[51] Int. Cl.[2] ..... E02D 23/08

[58] Field of Search ..... 61/46.5, 50, 52, 53, 53.74, 61/53.52

[56] References Cited

UNITED STATES PATENTS

| | | | |
|---|---|---|---|
| 2,924,947 | 2/1960 | Peterson | 61/53.74 |
| 3,054,268 | 9/1962 | Muller | 61/52 |
| 3,178,893 | 4/1965 | Fiore | 61/53 |
| 3,470,701 | 10/1969 | Turzillo | 61/53.52 X |

FOREIGN PATENTS OR APPLICATIONS

| | | | |
|---|---|---|---|
| 1,088,804 | 10/1967 | United Kingdom | 61/46.5 |

*Primary Examiner*—Jacob Shapiro
*Attorney, Agent, or Firm*—Larson, Taylor and Hinds

[57] ABSTRACT

This invention provides a caisson adapted to bear against the sea floor, constructed such that it contacts the sea floor with a minimum of motion. The caisson includes downwardly protruding members which make first contact with the sea bottom, thereby reducing the motion of the caisson by an acceptable level when the more fragile portions reach the sea floor.

15 Claims, 19 Drawing Figures

FIG.1.
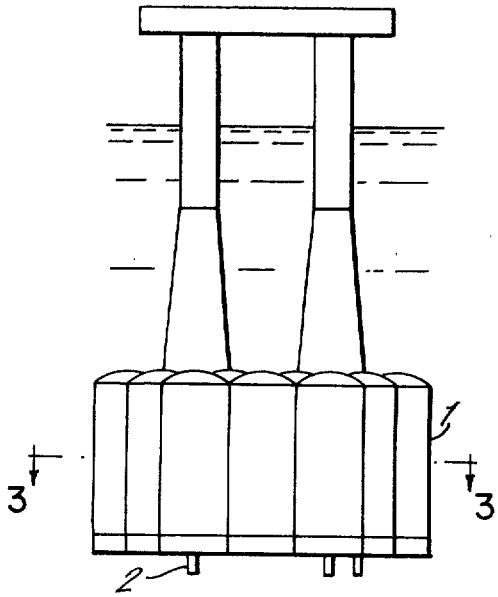
FIG.2.
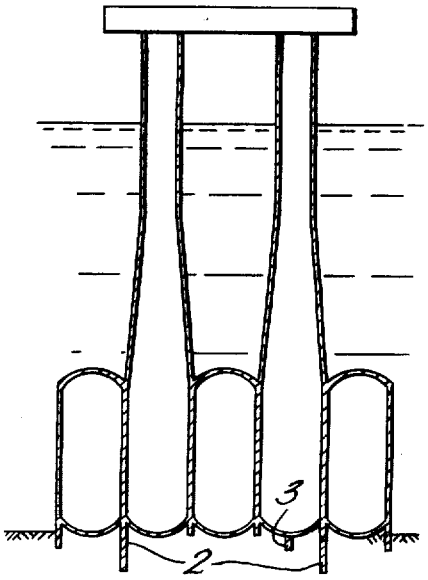
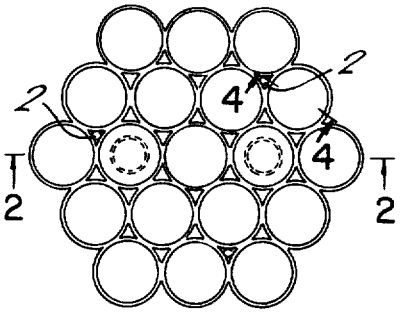
FIG.3.
FIG.5.
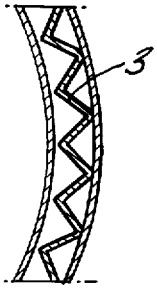
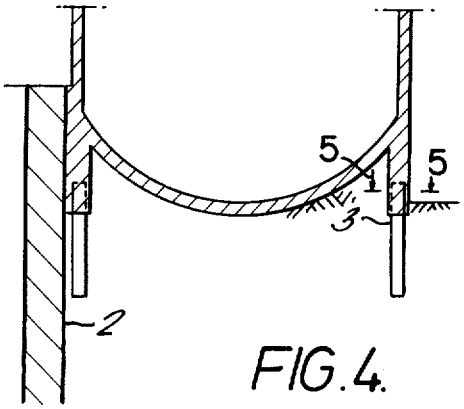
FIG.4.

ARRANGEMENT IN OR RELATING TO CAISSONS OR THE LIKE

The present invention relates to an improved version of marine structures placed on the sea floor and particularly used as storage tanks or foundation for structures like platforms, breakwaters, lighthouses or the like. These marine structures will also be referred to hereinafter as caissons.

FIG. 1 is a side elevational view of a caisson constructed in accordance with the present invention.

FIG. 2 is a vertical sectional view taken along line 2—2 of FIG. 3.

FIG. 3 is a horizontal sectional view taken along line 3—3 of FIG. 1.

FIG. 4 is a partial sectional view taken along line 4—4 of FIG. 3.

FIG. 5 is a horizontal sectional view taken along line 5—5 of FIG. 4.

Figure 6:
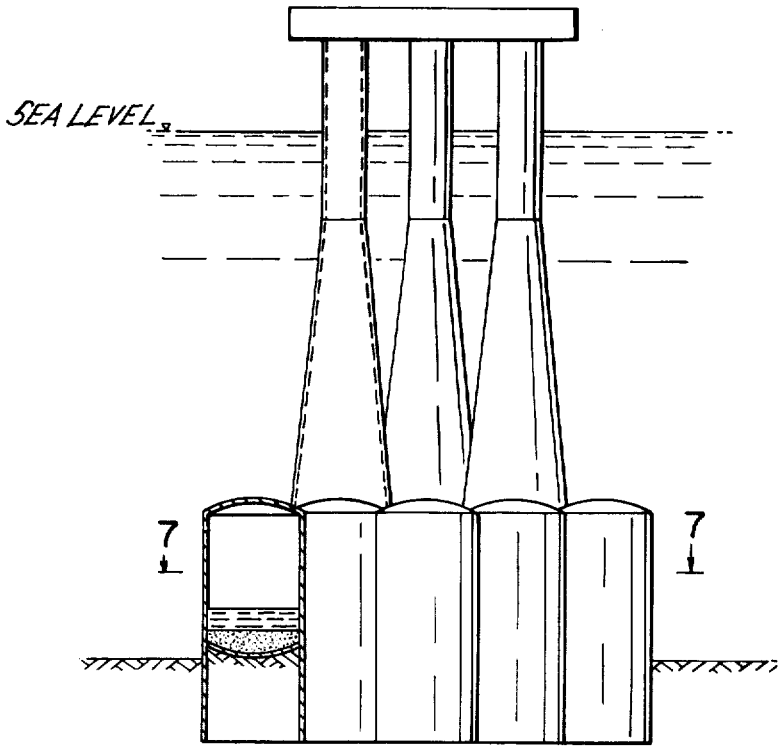
FIG. 6 is a side elevational view with a portion showing in section a modification of the invention.
Figure 7:
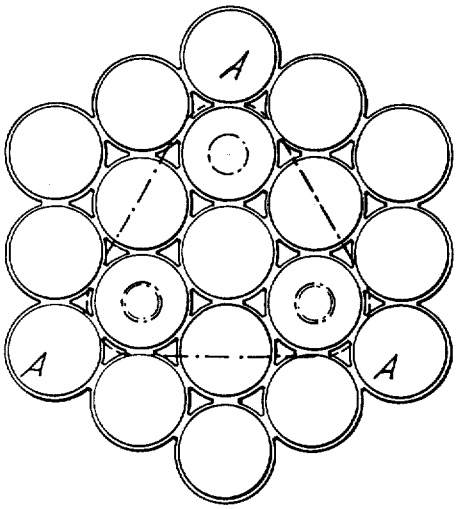
FIG. 7 is a horizontal sectional view taken along line 7—7 of FIG. 6.

To place a caisson on the sea floor for the above mentioned purposes is known, for example from U.S. Pat. application Ser. No. 232,665, filed Mar. 8, 1972, which issued on July 23, 1974 as U.S. Pat. No. 3,824,795. As shown in FIGS. 1–5, such caissons most often will be furnished with cutting edges (skirt) 3 in order to reduce the danger of washing out of the sea floor material from under the caisson. FIGS. 6–7 show a caisson equipped with long skirts whose main purpose is to transfer the forces far down into the ground. Such skirts can also have as purpose to form a constraint for injected material.

In many cases such skirts will have to be made very thin; otherwise, it will be impossible to insert them into the ground. Such thin skirts, however, will be very sensitive during the insertion phase because waves, current and wind will cause the caisson to be in motion as it contacts the sea floor. This motion will mainly be in the horizontal direction and it is evident that a thin skirt, made for instance of 20 mm steel plate, will be destroyed when it is subjected to a transverse edge load of several hundred tons. In order to make use of such skirts possible, it is necessary that the caisson has no horizontal movement as it hits the sea floor.

The present invention solves the above mentioned problem by equipping the caisson with strong protruding members, for instance piles, which extend a few meters down past the lower edge of the skirt. These piles will be the first to hit the sea floor. Depending on its length, however, there is a limit to the load that such a pile can be subjected to. In sand or clay, the pile will only plow a furrow in the sea floor and thereby slow down the horizontal motion without the pile being subjected to large inertia forces due to the deceleration. As the caisson is lowered further slowly, the piles will be driven down into the ground while the caisson's motion will be less and less. Finally, the ground pressure on the pile will be larger than the horizontal forces on the caisson from waves etc. and the caisson's lower edge will no longer have horizontal motion. If the skirt does not hit the sea floor before this stage, it will be possible to use very thin and fragile skirts without any danger that these will break due to transverse forces.

FIGS. 1–5 show a proposed design for an oil field in the North Sea. This platform was supposed to be installed in a place where the ground consisted of very hard sand which is easily subjected to erosion. It was assumed that no washing out of the sand would occur if a skirt 4 meters deep could be used. At this depth, however, the sand had a firmness corresponding to good concrete; therefore, it would not have been possible to press down a skirt having a thickness of more than a few centimeters since sufficient penetration force would otherwise not be available. It may have been possible to flush out material under the skirt, but this would have been excessively expensive. The problem was suggested solved by the use of piles 2 in accordance with the invention. Calculations showed that three piles of 2 meter's diameter would receive sufficient pressure from the sand if they extended 4–5 meters down into the sand. The platform could therefore be equipped with a thin steel skirt 3 when piles extending 5 meters below the lower edge of the skirt were concurrently installed. In this case, the piles were supposed to be made of steel pipe of 2 meter's diameter cast in place at their upper end.

The piles will obviously increase the penetration resistance. By using steel pipe for the piles, however, the increase will be minimal. Also, it is relatively simple to flush out room for a small number of piles. The pile can also be made telescopical.

The piles in accordance with this invention must not be mistaken for usual piles for the purpose of taking up forces in the finished structure. On the other hand, it is clear that when the piles in accordance with the invention are installed, they will act as usual piles and be of use also after having served their real purpose.

Figure 19:
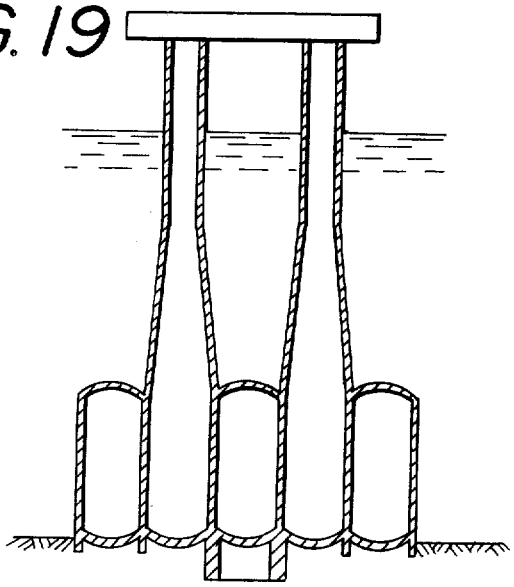
FIG. 19 is a central longitudinal sectional view of FIG. 18.
Figure 18:
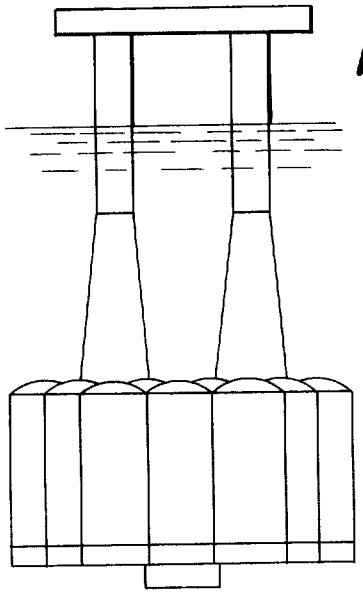
FIG. 18 is a side elevational view of another modification of the invention.

The protruding members in accordance with the invention can obviously be implemented in a number of ways. Piles in the form of open steel pipe has been mentioned. Concrete piles can also be imagined. It can also be imagined that the skirt itself is reinforced and is made deeper than the lower edge of the skirt on a number of places. Such a solution would be natural when the skirt is made of concrete like in FIGS. 6 – 7. If a special pile were used in this case, it could be stiffened by the concrete skirt because the skirt is strong in places where more skirts join together. FIGS. 18 and 19 illustrate an arrangement wherein the pile is formed by reinforcing one of the skirts in the foundation by elongating this skirt down below the remaining skirts.

The parts to be protected do obviously not have to be a skirt but can be any fragile construction placed under the bottom of the caisson. One can imagine geotechnical measuring instruments and protruding flushing devices.

Figure 8:
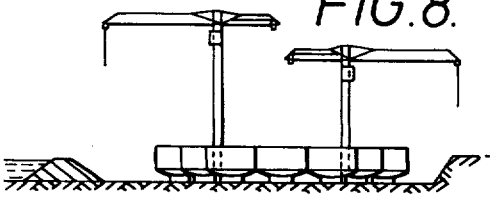
FIGS. 8 through 17 illustrate the steps in a method of making and installing a caisson in accordance with the present invention.
Figure 9:
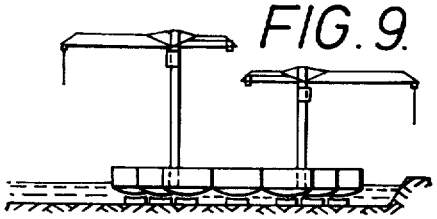
Figure 10:
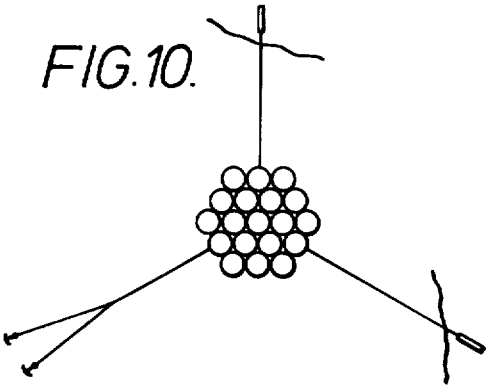
Figure 11:
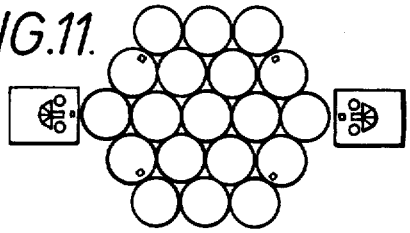
Figure 12:
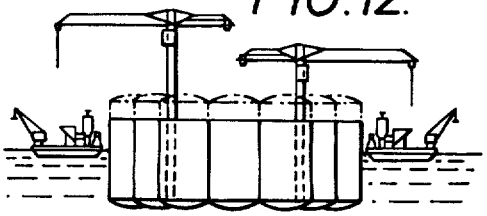
Figure 13:
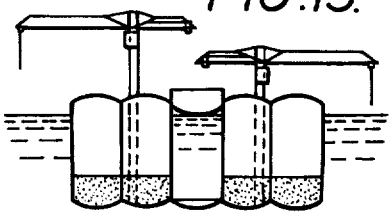
Figure 14:
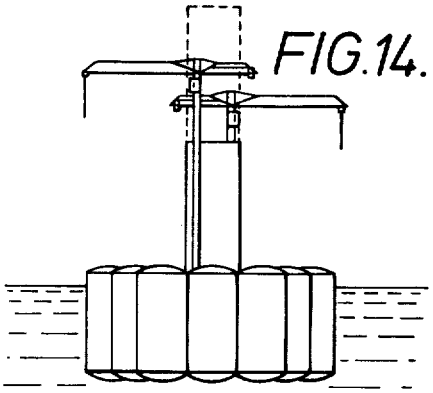
Figure 15:
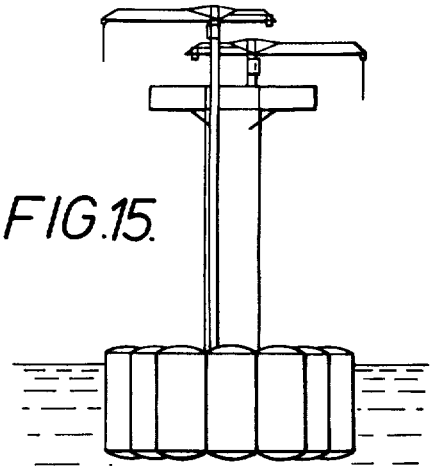
Figure 16:
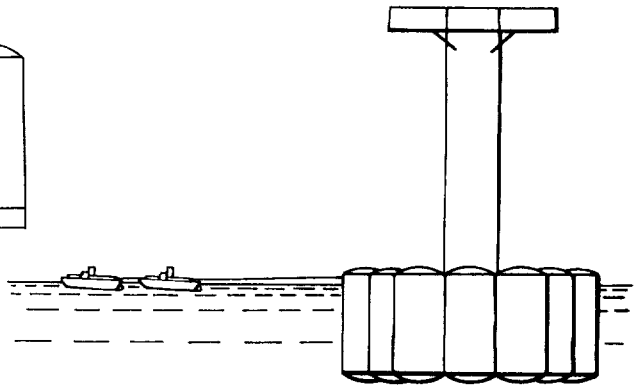
Figure 17:
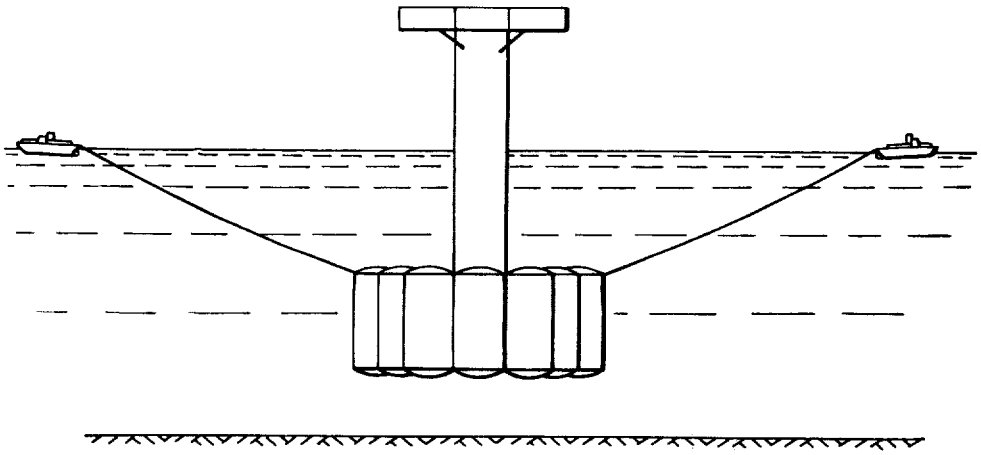

Normally, the shown caisson will be made by first making the bottom part in a dry dock and thereafter towing it into deep water where the work can be finished, see FIGS. 8–17. FIG. 8 shows the construction of the bottom sections in a dry dock and FIG. 9 shows removal of the dry dock gate for floating the bottom sections. FIG. 10 shows anchoring of the new construction at the site and FIG. 11 shows the arrangement of the construction equipment at the sight. FIG. 12 shows the slipform work on the walls while FIG. 13 illustrates the construction of a caisson top slab. FIG. 14 illustrates the slipform workshaft while FIG. 15 illustrates the construction of the decks. FIG. 16 illustrates towing the caisson to the location at which it is to be placed into the sea floor and FIG. 17 shows the actual lowering of the caisson to the selected location at the sea floor. It is also possible to make the entire caisson in a dock. By this method, piles in accordance with the invention will increase the necessary depth of the dock by several meters, which is disadvantageous. This can be avoided by making the caisson in the normal way, towing the structure out into deep water and adding the piles when the structure is afloat (FIG. 12). In the version shown in the figures, the caisson has several through-going vertical openings. The piles can be constructed by lowering steel pipes down through these openings to the prescribed depth and filling the lower part of the opening with concrete, so that the upper part of the pile is cast in place. This casting can be done as underwater casting in the usual known way. If the pile is equipped with flushing devices, geotechnical measuring instruments or the like, these can be mounted in advance so that the subsurface work becomes minimal.

If the pile is made of concrete, the form and reinforcing materials can be lowered in the same way as a steel pile, and the casting can be done in the form of underwater casting or by pumping the form empty.

In the above, the major importance is placed on the fact that the piles prevent horizontal motion when the structure reaches the sea floor. The piles will also be useful in dampening vertical motion for instance created by waves. Large vertical motion can be dangerous if the skirt for instance hits a stone. Such motion could also create high pressure in the water trapped inside the skirt and this pressure can in turn damage the ground.

It will be evident that the embodiments shown on the drawings and described above are only meant to illustrate the invention and that a large number of variations are possible within the scope of the invention.

The term "caisson" used in this description and in the claims is meant to include all forms of larger containers, tanks, submergable barges or ships or the like.

I claim:

1. A method of placing at a given location on the sea floor a marine structure of the type for supporting a deck, said marine structure having a large volume and weight and having very thin skirts which project down below the structure, the skirts being intended to penetrate the sea floor to a stable depth which is sufficient to transfer the main sea forces caused by motion of the sea water to the ground of the sea floor so that the marine structure is stable against movement under the action of such forces, comprising the steps of:

transporting the marine structure in erected position to a point in the sea above the said location with the skirt structure extending downwardly, and with pile means extending downwardly below the bottom of the skirt, the pile means being substantially stronger than the skirt and of sufficient size and strength to withstand the initial sea forces causing a horizontal movement during penetration, said pile means having a cross-section substantially smaller than the cross-sectional area of the marine structure, lowering the marine structure until the bottom of the pile means engages the sea floor, and continuing to move the marine structure downwardly as the pile means penetrate the sea floor to a depth sufficient to receive the said initial sea forces and transfer them to the ground before the skirt reaches the sea floor, thus reducing to an acceptable level the motion of the marine structure caused by the initial sea forces before the bottom of the skirt reaches the sea floor, and continuing to lower the marine structure until the said thin skirt penetrates the sea floor to said stable depth.

2. The method of claim 1, including the step of attaching the pile means to the marine structure at the place above said location.

3. The method of claim 2, in which the marine structure is made up of a plurality of sections secured together with at least some openings between some of said sections, and the step of attaching the pile means includes lowering piles down through at least some of said openings.

4. The method of claim 1, including fabricating a floating portion including at least the bottom of the marine structure in a dry dock and towing the same by floating it to deep water and attaching the pile means to the marine structure at said deep water.

5. A marine structure of the type for being firmly secured to the sea floor for supporting a deck, comprising:

a large base having a large cross-section and weight, intended to rest on the sea floor, a superstructure projecting up from the base and extending up above sea level and supporting the deck, a skirt attached to the base and extending downwardly therefrom, said skirt being sufficiently thin and having a height extending below the base such that it penetrates the sea floor to a depth which is sufficient to transfer to the sea floor main sea forces caused by the motion of the sea water so that the marine structure is stable against movement under the action of such forces, pile means attached to the marine structure and extending downwardly below the bottom of the said skirt, said pile means being substantially stronger than the skirt to withstand initial sea forces causing a horizontal movement during penetration, and having a cross-section considerably smaller than that of the base, whereby the pile means engage the sea floor to reduce horizontal movement of the marine structure in the installation phase under the action of said initial sea forces before the bottom of the skirt engages the sea floor, so that the skirt can move downwardly into the sea floor to said stable depth.

6. A marine structure according to claim 5, said marine structure being a floating structure such that it can be floated to the selected location before being lowered to the sea floor.

7. A marine structure to claim 6, said pile means comprising at least one, vertically extending pile.

8. A marine structure according to claim 7, wherein said pile means is formed as a hollow pipe.

9. A marine structure according to claim 8, wherein said pipe has circular cross-section.

10. A marine structure according to claim 8, wherein said pipe has a polygonal cross-section.

11. A marine structure according to claim 8, wherein the pile means are filled with concrete after having been put in place.

12. A marine structure according to claim 5, wherein the pile means is formed by reinforcing and elongating a section of the skirt.

13. A marine structure according to claim 5, wherein the pile means is formed of concrete.

14. A marine structure according to claim 7, wherein the pile means is formed by steel.

15. A marine structure according to claim 5, wherein the pile means is formed as a combination of steel and concrete.

* * * * *